United States Patent [19]

Kaplan

[11] 4,190,463

[45] Feb. 26, 1980

[54] METHOD OF REMOVING IRON OXIDE DEPOSITS FROM HEAT TRANSFER SURFACES

[75] Inventor: Roy I. Kaplan, Naperville, Ill.

[73] Assignee: Nalco Chemical Company, Oak Brook, Ill.

[21] Appl. No.: 9,563

[22] Filed: Feb. 5, 1979

[51] Int. Cl.[2] ..... B08B 3/08

[52] U.S. Cl. ..... 134/3; 134/28; 252/83

[58] Field of Search ..... 134/3, 26, 28, 41; 252/83, 84, 85

[56] References Cited

U.S. PATENT DOCUMENTS

| | | | |
|---|---|---|---|
| 80,544 | 8/1868 | Hewitt | 252/84 |
| 103,661 | 5/1870 | Rogers | 252/84 |
| 119,426 | 9/1871 | Sweet | 252/84 |
| 170,137 | 11/1875 | Weiss | 252/84 |
| 181,373 | 8/1876 | Taylor | 252/84 |
| 182,774 | 10/1876 | Riley | 252/84 |
| 258,235 | 5/1882 | Kolker | 252/84 |
| 268,461 | 12/1882 | Cryer et al. | 252/84 |
| 1,747,638 | 2/1930 | Markley et al. | 252/84 |
| 2,411,074 | 11/1946 | Winkelmann et al. | 252/83 |
| 2,472,684 | 6/1949 | Rossi | 252/84 X |
| 2,529,177 | 11/1950 | Nieland et al. | 252/180 X |
| 3,003,898 | 10/1961 | Reich | 134/41 X |
| 3,095,862 | 7/1963 | Berner | 252/180 X |
| 3,317,431 | 5/1967 | Kaye | 252/180 |
| 3,375,200 | 3/1968 | Robertson | 252/84 X |
| 3,510,432 | 5/1970 | Squire | 134/3 X |
| 3,753,924 | 8/1973 | Franiau | 252/83 X |
| 3,957,529 | 5/1976 | Alexander et al. | 134/28 X |

FOREIGN PATENT DOCUMENTS

| | | | |
|---|---|---|---|
| 1732 | of 1859 | United Kingdom | 252/83 |
| 12357 | of 1887 | United Kingdom | 252/83 |

*Primary Examiner*—Marc L. Caroff

*Attorney, Agent, or Firm*—John G. Premo; Robert A. Miller

[57] ABSTRACT

Iron oxide deposits which are found on heat transfer surfaces can be removed by first contacting these deposits with an aqueous solution of a hydrolyzable tanning extract such as sumach, valonea, or chestnut tannin which conditions the deposits and forms a complex thereof. The thus-formed complex is subsequently removed by treatment with dilute solutions of citric acid.

6 Claims, 5 Drawing Figures

SOLUBILITY OF IRON COMPLEXES IN CITRIC ACID

SOLUBILITY OF IRON COMPLEXES IN CITRIC ACID

METHOD OF REMOVING IRON OXIDE DEPOSITS FROM HEAT TRANSFER SURFACES

INTRODUCTION

Figure 1:
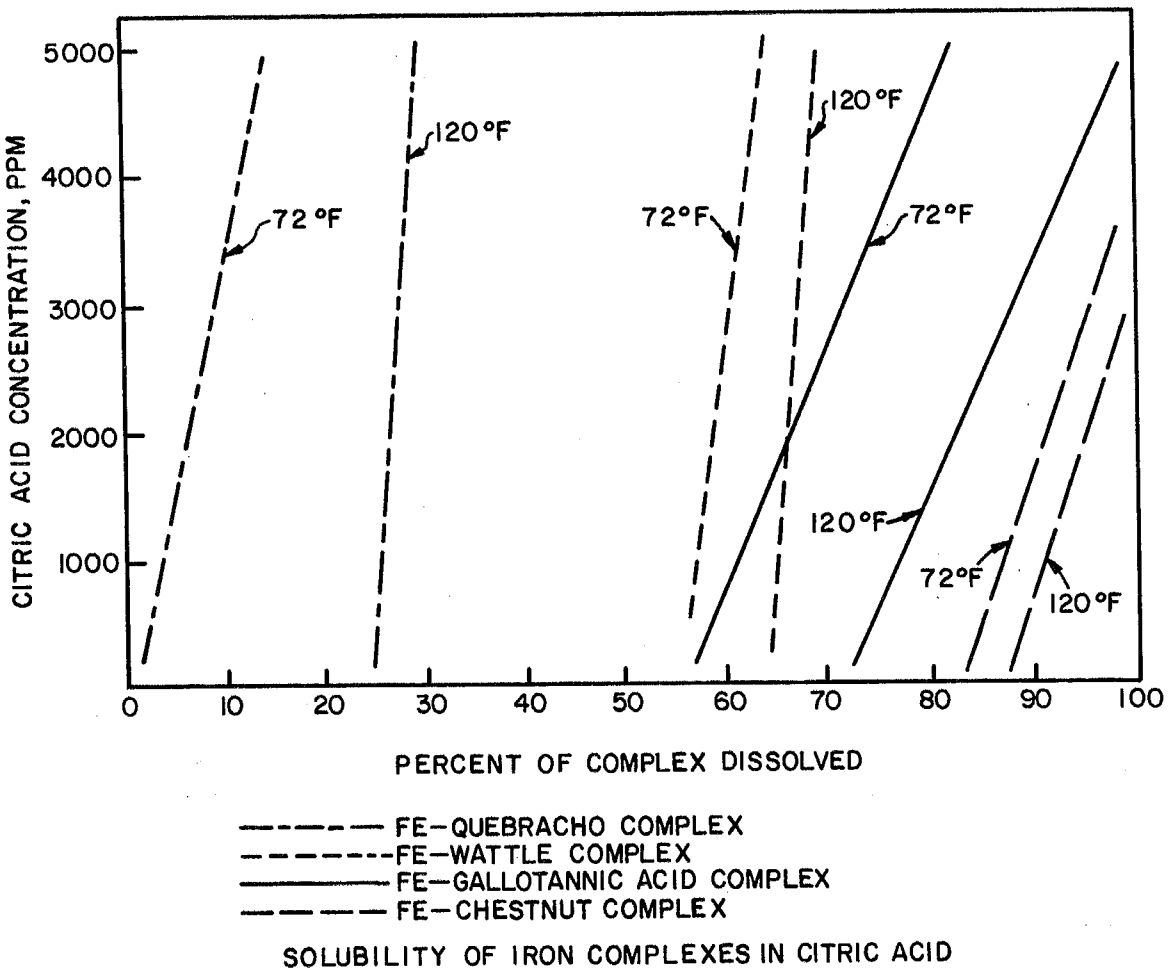

Most industrial heat exchangers are composed of bundles of ferrous metal tubes. In some instances, nonferrous metals such as admiralty metal are used. These heat exchange systems are water-cooled, with the heat absorbed by the water being removed atmospherically by cooling towers. These industrial cooling systems rapidly form iron oxide deposits which reduce their heat transfer efficiency. It is common to mechanically clean these systems when the iron oxide deposits become excessive. Mechanical cleaning, while effective in many cases, is time-consuming and expensive.

The heat exchangers thus described should be distinguished from the heat transfer surfaces of boilers. The distinction is that the scale in boilers is most often composed of calcium or magnesium salts and is relatively low in iron oxide. Industrial heat exchangers of the type described normally contain deposits which are predominantly composed of the oxides of iron. Therefore, the specification and claims, when referring to heat transfer surfaces and heat exchangers, means industrial heat exchangers and not boilers.

THE INVENTION

A method for removing iron oxide deposits from heat transfer surfaces which comprises the sequential steps:

(a) contacting such surfaces with an aqueous solution which contains at least 25 parts per million of a hydrolyzable tanning extract and has a pH of not more than 8.5 for a period of time sufficient to modify a substantial portion of the iron oxide deposits; and then, (b) removing the modified deposits formed in step (a) with an aqueous solution having a pH not greater than 4 which contains at least 1000 parts per million of citric acid.

The Hydrolyzable Tanning Extract

This group of tanning extracts represents a distinct species of tannins over the so-called condensed tanning extracts. The hydrolyzable tanning extracts most advantageously employed in the practice of the invention are sumach, valonea, or chestnut tannin, with the latter being preferred. For a more detailed discussion of tannins, see the *Encyclopedia of Chemical Technology*, Second Edition, Volume 12, Interscience, 1972, page 321 et. subs.

The hydrolyzable tanning extracts are most preferably employed at ranges between 50–1000 ppm with solution concentrations of 100–300 ppm appearing to be optimal. The pH of these solutions should not exceed 8.5 and is preferably within the range of 3.0–7.5. While the hydrolyzable tanning extracts are effective when used alone, it is oftentimes beneficial that they be used in conjunction with a water-dispersible surfactant, preferably a nonionic surfactant. Surfactants of this type are described in *McCutcheon's Detergents & Emulsifiers*, 1974 North American Edition, Published by McCutcheon's Division, Allured Publishing Corporation. A preferred surfactant is nonyl phenol reacted with 9 moles of ethylene oxide. The amount of time necessary for the hydrolyzable tanning extract to act upon and complex with the iron oxide deposits varies depending upon a number of conditions. A general rule is that the minimum time required is at least 12 hours with time periods ranging from between 12 hours to as long as several days sometimes being required to adequately complex with the iron oxide deposits. Such variables as the temperature of the system during the treatment with the hydrolyzable tannin extract, the nature and quantity of the deposit, the pH of the system, and the like will govern the time of the treatment which cannot be expressed with exactitude. The optimum conditioning parameters for chestnut tannin were found to be a 100–500 ppm solution circulated for 2–3 days with the pH being about 3–7.

Citric Acid

The citric acid treatment which follows after the hydrolyzable tanning extract treatment should employ citric acid solution which contains at least 1000 ppm with the pH not being in excess of 4. In most instances, the pH of the citric acid solution should be about 3.0–3.4. A pH of 2.8–3.8 should be maintained to obtain maximum advantage of citric acid. A preferred dosage range of the citric acid is within 2000–4000 ppm.

The time required for the citric acid to remove the hydrolyzable tannin extract iron deposits will vary between a few hours up to as long as a day or more depending upon the environment of the system, e.g. pH, tannin extract employed, quantity of suspended or tannated iron oxide in the system, temperature and the like. In most cases, a time of about 18 hours using optimum citric concentration and pHs will give good cleanup.

Rather than continuing the citric acid treatment for a fixed period of time, it is possible to monitor the soluble iron levels during the citric acid treatment. The treatment can be discontinued when the iron levels are above about 500–600 ppm.

Temperature

The treatment with the hydrolyzable tannin extract and the citric acid may be conducted over a wide temperature range but below the boiling point of the treating solutions used to practice the invention. While ambient temperatures may be used, it is preferred that the temperatures in excess of 100° F. be used with a preferred temperature range being 100°–150° F.

A typical cleaning procedure for an iron fouled heat exchanger would be as follows:

1. Discontinue the corrosion inhibition program, if used.
2. Add 200–300 ppm tannin and 5–10 ppm of Comp. N[1] to the system and circulate. Maintain the pH at 6–7 and a temperature of 110°–130° F. As the tannin concentration is reduced to less than 50 ppm by consumption, add more tannin to increase the dosage to 200–300 ppm.

[1]See Glossary, page 8(a).

3. Discontinue tannation after 2–3 days depending upon the severity of the fouling.
4. Dump the system or blow-down heavily.
5. Refill with clean water and add citric acid at 2,000–4,000 ppm, pH 2.7–3.2, and a temperature of 110°–130° F.
6. Monitor soluble iron levels and when soluble iron reaches 500 ppm, blow-down heavily and add more citric acid.
7. Repeat step 6 for three or four times. (Blow-down may contain fragments of iron tubercles at this stage.)

8. Blow-down system and return to the normal corrosion inhibition program, if used. If possible, the system should be monitored for leaks throughout the program and discontinue treatment if leaks develop.

Unusually thick iron oxide deposits or deposits containing large amounts of silica are extremely difficult to remove using the above chemical treatment. In such cases, the mass of deposit should be removed by mechanical means prior to chemical treatment.

Iron-Tannin Complex Solubility Studies

Iron complexes of gallotannic acid, Quebracho tannin, wattle tannin, and chestnut tannin were prepared in the following manner. Ten grams of $FeCl_3$ dissolved in a minimum of water was added to five grams of the appropriate tannin or tannic acid dissolved in water. The dark purple to black precipitate that formed was filtered, washed, and dried. In the case of chestnut tannin, its iron complex was extremely finely divided and probably colloidal. A water suspension of this complex had to be evaporated to dryness for the solubility tests.

To determine the solubility of each of the iron complexes in citric acid (and hence its ease of removal from a tannated iron substrate), the following scheme was used. A 100 mg. sample of each iron complex was placed in a separate 100 ml portion of citric acid ranging in concentration from 500 to 5,000 mg/l. After two hours of intermittent stirring, the suspensions were filtered and dried. The amount of dissolution was determined by weight differences before and after citric acid treatment. Data from these experiments, conducted at 72° and 120° F. are shown in FIG. I.

Clearly, the solubility of the iron-Quebracho complex is far too low to be considered for practical usage. Indeed, Quebracho might lead to fouling in iron laden systems that would not be recovered in the subsequent citric acid step. Based solely on solubility considerations, the chestnut tannin is preferred since its chance of dissolution approaches 100 percent in heated systems. The iron-gallotannic acid complex is adequately soluble in citric acid; however, the high cost of the acid could preclude its usage.

Heat Transfer Unit Tests (HTU)

Heat transfer unit experiments were run to determine the effects of tannins and citric acid on mild steel heat transfer tubes. In most cases, the heat flux was 10,000 BTU/ft$^2$/hr. and the flow rate was 2.8–3.6 ft/second. Bulk water temperature was 125° F. Three types of water were used ranging in hardness from 100 to 1200 ppm Ca, but no significant differences were evident.

Twelve of the most significant runs are outlined in Table I. All were conducted in three cycle Chicago tap water. After each test listed, the significance of the findings of that test is given. Many of the findings of the solubility testing were verified during this phase of the work. The appropriate tannin type, concentration, time of tannation, and the relative unimportance of pH during deposit conditioning were determined. Optimum conditioning parameters were found to be chestnut tannin, 100–500 ppm, 2–3 days, and pH 3–7.

Citric acid must be applied at a minimum dosage of 1000 ppm and a pH of 3.0–3.4. Lower concentrations and higher pH values are not effective in deposit removal. However, higher concentrations and lower pHs improve the rate of deposit removal at the expense of increased corrosion rates. Surfactants and dispersants have some utility in the process, primarily for systems with oil or silt present.

Pilot Cooling Tower Runs (PCT)

Eleven pilot cooling towers were used to verify all the conditions found for optimum iron oxide cleanup during previous testing. Significant differences between PCT and HTU tests are lower temperatures for the PCTs (100° F. vs. 125° F.) and slightly lower flow rates (0.1–2.5 ft/sec. vs. 2.8–3.6 ft/sec). The PCTs also incorporate the possibility of using mixed metallurgies with the inherent possibility of fouling from corrosion of other tubes in the system.

Two of the pilot cooling towers, A and B, used 7-tube shell side heat exchangers. These towers as well as Towers D and E used heat exchanger tubes equipped with thermocouples to follow fouling and defouling during all phases of the procedure.

Figure 2:
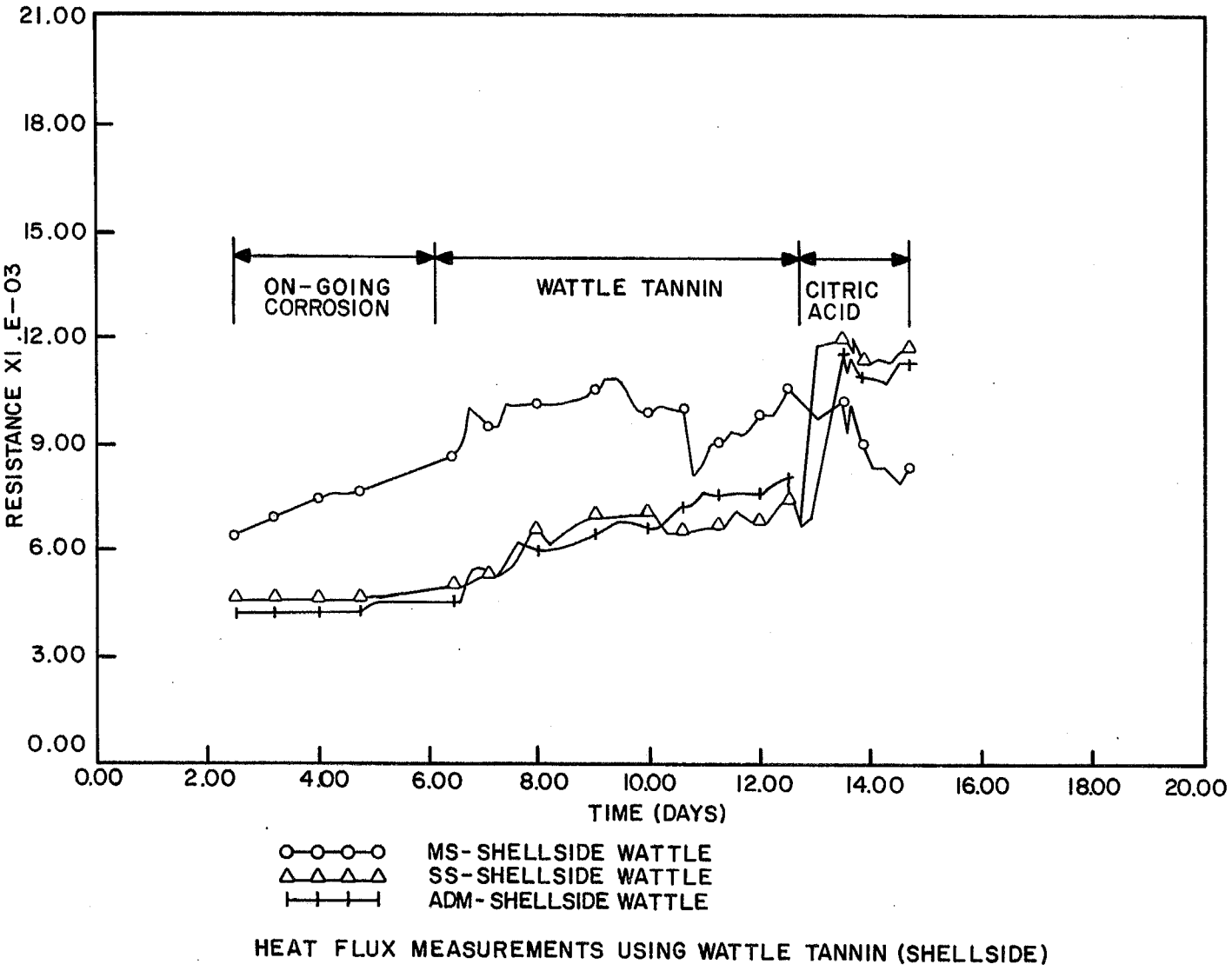
Figure 3:
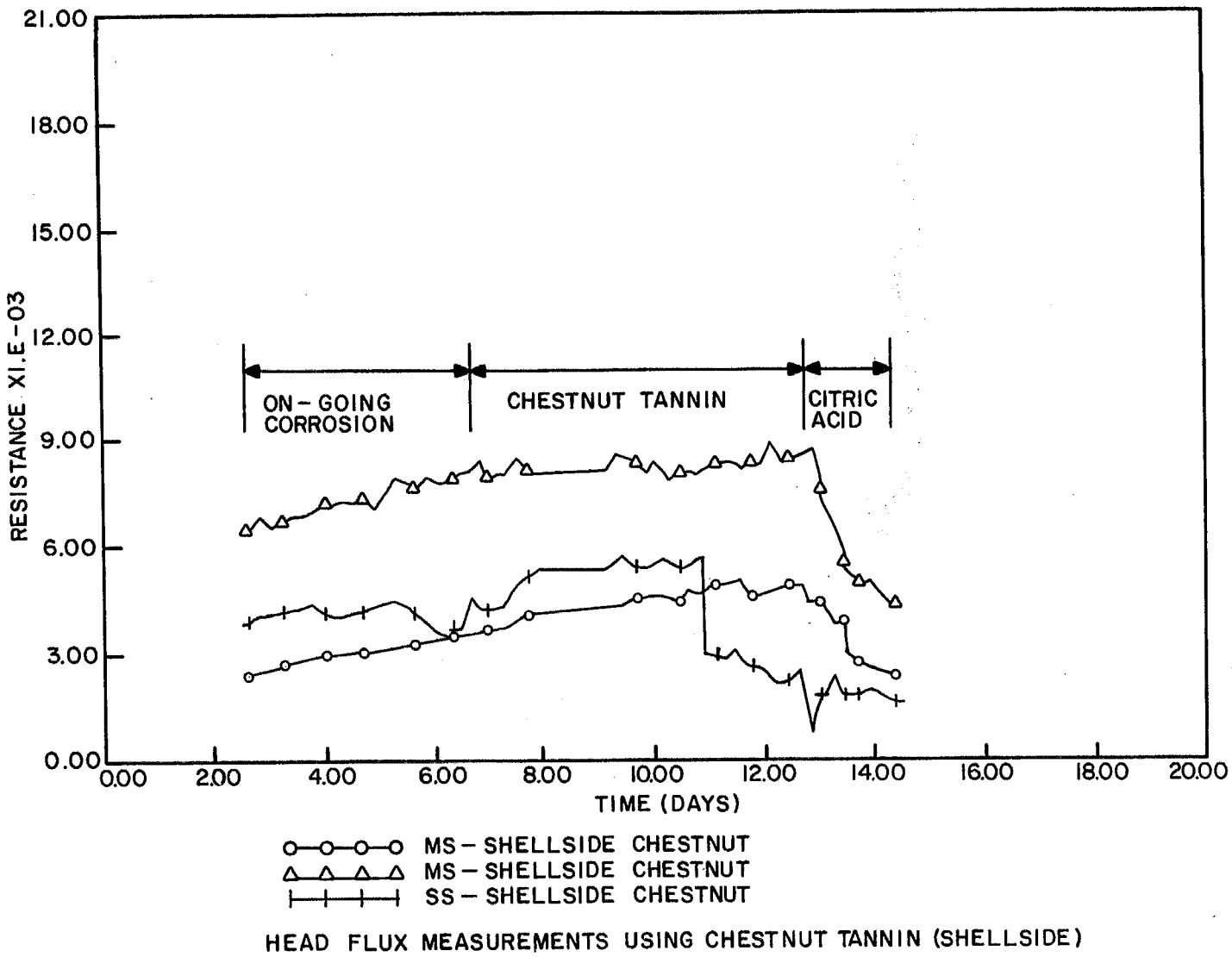
Figure 4:
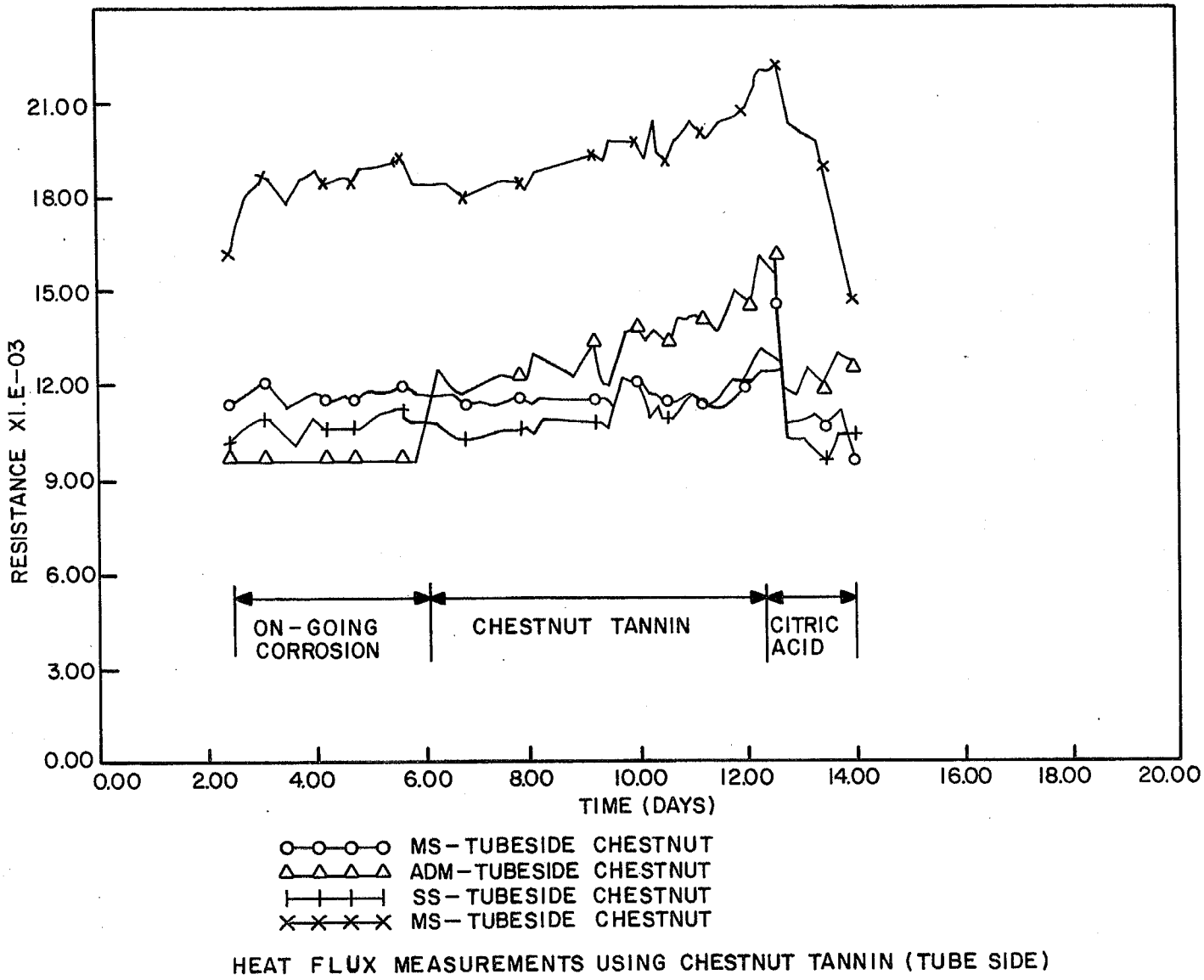
Figure 5:
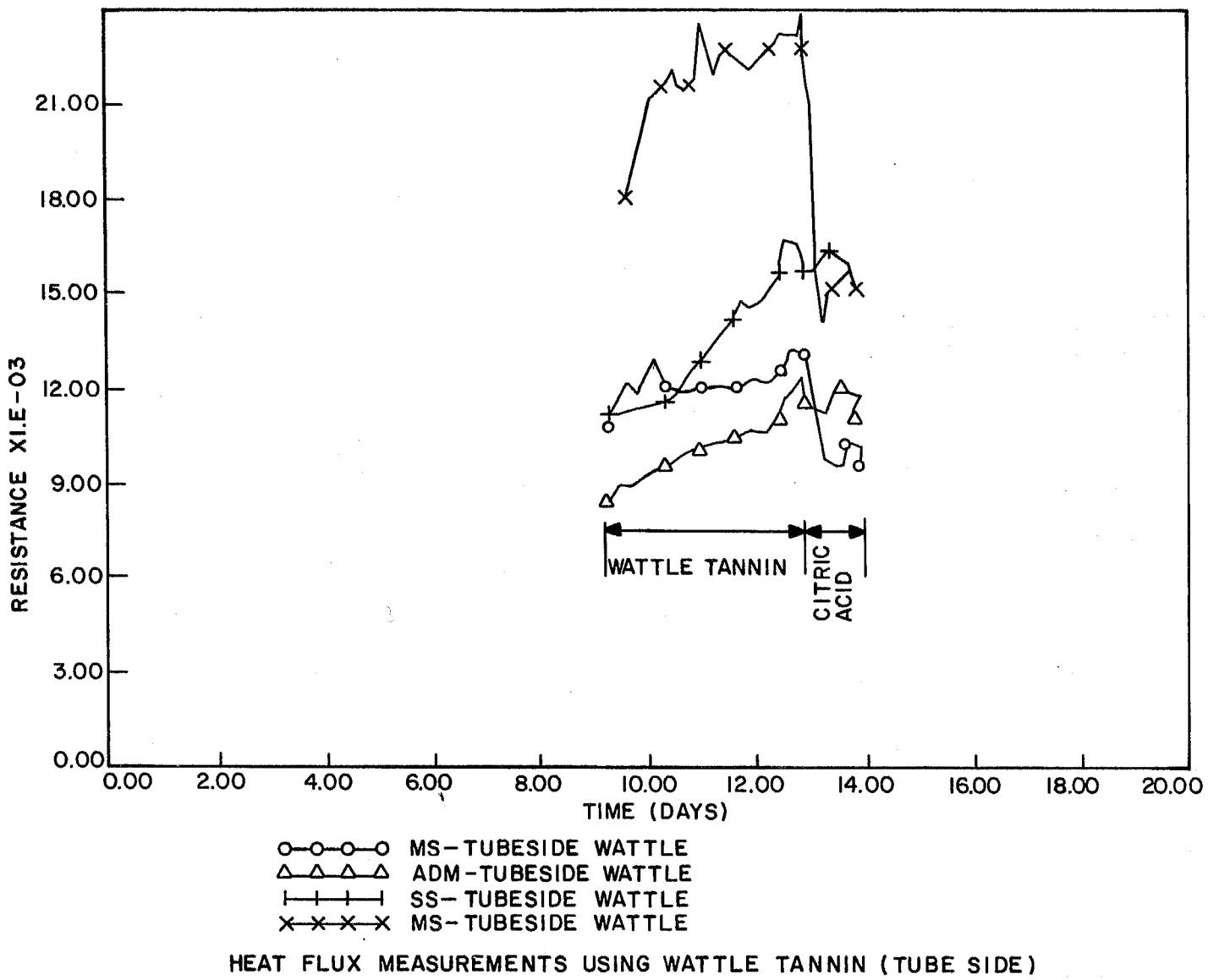

The PCT experiments are outlined in Table II with a summary of each run given at the end of the test. For Towers A, B, D, and E, FIGS. 2–5 show graphically the results of each phase of the program.

Many of the parameters and conditions discovered in HTU work were confirmed and new facts were uncovered. For instance, chestnut tannin is preferable to wattle tannin; concentrations of 50–200 ppm are adequate, thick, aged deposits are difficult to penetrate and remove; oil and silt should present no unsolvable problems; low pH conditions are absolutely necessary for citric acid to adequately remove tannated deposits; repeated "shocks" up to 3,000 ppm of citric acid are preferable to constant feeding, long-term treatments; high concentrations of ferric ion cause increased corrosion and should be removed as soon as possible; and it is possible to passivate a cleaned system with Comp. F[1] and an appropriate corrosion inhibitor.

[1]See Glossary, page 8(a)

The Heat Transfer Unit tests (HTU) as well as the Pilot Cooling Tower tests (PCT) are described in detail in the article, "Small-Scale Short-Term Methods of Evaluating Cooling Water Treatments. . . Are They Worthwhile?" by D. T. Reed and R. Nass, Nalco Chemical Company, presented at the 36th Annual Meeting of the International Water Conference, Pittsburgh, PA, Nov. 4–6, 1975, which is incorporated herein by reference. Various lettered materials used in Tables I & II are set forth in the Glossary.

GLOSSARY

B—Benzotriazole

D—A glassy polyphosphate

E—A low molecular weight sodium polyacrylate

F—A film forming passivator for metal systems containing sodium pyrophosphate, sodium acid pyrophosphate, nonyl phenol $R_x$ 8 moles ethylene oxide (surfactant), and benzotriazole.

G—Corrosion inhibitor containing chromate and zinc in a 7 to 1 ratio.

H—A scale dispersant containing hydroxyethylidene diphosphonic acid and sodium polyacrylate.

I—A biocide whose active agents include methylene bis thiocyanate and 2,4,5-trichlorophenol.

J—A corrosion inhibitor containing sodium lignosulfonate, zinc chloride, and polyolester (see U.S. Pat. No. 3,502,587).

L—Deposit from a commercial cooling tower basin, Chicago area. Contains 28% Si, 21% Ca, 17% Fe, 7% Al, 4% Mg, 4% S, 2% Zn, 13% carbonate, and 5% $CHCl_3$ extractables.

M—Modified polyethoxylated straight chain alcohol (nonionic).

N—Octyl phenoxy polyethoxyethanol (surfactant).

O—A corrosion inhibitor containing a glassy polyphosphate and polyolester (see U.S. Pat. No. 3,502,587)

P—A surfactant-dispersant combination containing:
(a) octyl phenoxy polyethoxyethanol;
(b) polyethoxylate;
(c) a low molecular weight sodium polyacrylate.

TABLE I

SUMMARY OF HEAT TRANSFER UNIT STUDIES

| Test No. | Treatment, Concentration, pH, Duration | Results |
|---|---|---|
| 1. | (a) Tannic acid, 1000 ppm, pH 6–8, 5 days<br>(b) Citric acid, 2000 ppm, pH 3.2–3.6, 3 days<br>(c) Comp. F[1] 130 ppm, pH 6, 1 day | Darkened deposit after 2 hours.<br>Immediate flaking of deposit.<br>Maintained clean surface. |
| | Significance: Tannic acid modifies iron corrosion deposits equally well at higher pH values as it does at lower values. The overall treatment will successfully modify and remove deposits and passivate the cleaned surface. Costly tannic acid should be replaced by less expensive alternative. | |
| 2. | (a) Tannic acid, 500 ppm, pH 3–4, 6 days<br>(b) Citric acid, 1000 ppm, pH 3.2–3.4, 2 days | Darkening of oxides after 1–2 hours.<br>Immediate flaking of deposit followed by darkening of cleaned metal. |
| | Significance: Lower levels of tannic and citric acid clean corroded surfaces in approximately the same time as higher levels. | |
| 3. | (a) Tannic acid, 500 ppm, pH 3–4, 6 days<br>Comp. L, 1000 ppm<br>Comp. E, 20 ppm<br>(b) Citric acid, 1000 ppm, pH 3.2–3.4, 2 days<br>Comp. E, 20 ppm | Identical results as in test 2.<br><br><br>Same as in test 2. |
| | Significance: The process is successful in the presence of silt. A dispersant, Comp. E, may help keep removed solids from resettling heat transfer surfaces. | |
| 4. | (a) Chestnut tannin, 500 ppm, pH 6–7, 2 days<br>(b) Citric acid, 2000 ppm, pH 3.0–3.4, 1 day | Deposit turned purple after a few hours.<br>Purple color disappeared within minutes. Flaking started within 30 minutes. The tube was 85% clean in 1 hour. |
| | Significance: Chestnut tannin may be substituted for tannic acid with no loss in reactivity. | |
| 5. | (a) Quebracho tannin, 500 ppm, pH 5–6, 2 days<br>(b) Citric acid, 2000 ppm, pH 3.0–3.4, 3 days | Deposit darkened, but somewhat slower than with chestnut tannin.<br>Only partial removal of modified deposits. |
| | Significance: Difficulties in removing the treated deposits may be encountered if Quebracho tannin is substituted for chestnut tannin. | |
| 6. | (a) Wattle tannin, 500 ppm, pH 3–4, 2 days<br>(b) Citric acid, 2000 ppm, pH 3.0–3.4, 3 days | Darkening of deposit at a rate similar to chestnut.<br>Over 50% of deposit flasked off leaving a thin brown coating. |
| | Significance: The effectiveness of wattle tannin is intermediate to chestnut and Quebracho. | |
| 7. | (a) Chestnut tannin, 1000 ppm, pH 5.0–5.6, 2 days<br>(b) Chestnut tannin, 10,000 ppm, pH 4.5–5.0, 3 days | Same as in test 4.<br>No change |
| | Significance: Simple tannin dosage increases will not cause softened deposit to flake off under these flow conditions. | |
| 8. | (a) Chestnut tannin, 50 ppm, pH 6.5, 7 days<br>(b) Citric acid, 2000 ppm, pH 3.0–3.4, 4 days. | Deposit began to darken after 1 day.<br>Immediate flaking of deposit followed by dark brown deposit on surface. |
| | Significance: If the case warrants, high dosages of chestnut tannin for short periods may be replaced by low dosages for long times. The final results are identical. | |
| 9. | (a) Chestnut tannin, 250 ppm, pH 6.0–6.5, 7 days<br>Comp. E, 10 ppm<br>Comp. N, 5 ppm<br>(b) Citric acid, 2000 ppm, pH 3.0–3.4, 2 days | Same darkening as before, but deposits on glass portions clean up in this step.<br><br><br>Immediate deposit spalling. |
| | Significance: Addition of a dispersant, Comp. E, aids in cleaning up loosely held deposits even in the tannin step. It is not possible to see any benefit in the removal of | |

TABLE I-continued

SUMMARY OF HEAT TRANSFER UNIT STUDIES

| Test No. | Treatment, Concentration, pH, Duration | Results |
|---|---|---|
| | tenaciously held oxides. | |
| 10. | (a) Chestnut tannin, 100 ppm, pH 6.5, 7 days Comp. G, 40 ppm | The deposits gradually darken over the 7 day period. |
| | (b) Citric acid, 2000 ppm, pH 3.0–3.4, 4 days | The deposits finally flake off, but much more slowly then in other tests. |
| | Significance: The overlay of a chromate/zinc corrosion inhibition program will slow, but not prevent adequate deposit removal. Obviously, much of the tannin is oxidized by the chromate. | |
| 11. | (a) Chestnut tannin, 250 ppm, pH 6.0–6.5, 18 days | Thorough darkening of the deposits, but no evidence of spalling. |
| | Significance: Use of a one-step tannin procedure softens and tannates iron deposits, but this alone will not cause flaking of the deposit. | |
| 12. | (a) Chestnut tannin, 250 ppm, pH 6.0–6.5, 4 days | Same as before. |
| | (b) Citric acid, 2000 ppm, pH adjusted to 6.0, 10 days | No deposit removal. |
| | Significance: Use of citrates at higher pH's for long times are not effective for removing modified deposits. | |

TABLE II

PILOT COOLING TOWER RUN A

| | |
|---|---|
| Test and Tower No: | 1, A (Shell Side Exchanger) |
| Purpose of Test: | (a) To determine the effects of wattle tannin on corroded and non-corroded surfaces, (b) To examine the effects of water velocity and heat flux on deposit removal. |
| Water Type: | Three cycle Chicago tap; 0.1 ft/sec. |
| Tannin, Concentration, pH, | Wattle, 200 ppm; pH 6–7; |
| Reaction Time: | 5–7 days. |
| Other Additives: | 25 ppm Comp.B; 100 ppm Comp.N daily. |
| Specimens: | Admiralty tubes, 5000 and 15,000 BTU/ft$^2$/hr; stainless steel tubes, 5000 and 15,000 BTU/ft$^2$/hr.; mild steel tubes, 5000, 10,000 and 20,000 BTU/ft$^2$/hr. |
| Transition Between Tannin and Deposit Removal Agent: | Stop tannin feed, slug in removal agent, and maintain dosage. |
| Removal Agent, Concentration, pH: | Citric Acid, 2000 ppm, pH 3.4–3.8. |
| Other Additives: | 25 ppm Comp.B; 100 ppm Comp.N daily. |
| Transition Between Deposit Removal Agent and Corrosion Inhibition Program: | Stop citric acid feed, high level with corrosion inhibitor. |
| Passivation Technique and Agents: | Comp.J 150 ppm for 4 days, pH 7.6–8.0. |
| Transition Between Passivation and Maintenance Program: | Lower Comp.J level to 50 ppm. |

Summary of PCT Run: The addition of wattle tannin caused tannation of the mild steel tubes within a few hours. The stainless steel and admiralty tubes also began significant buildup as the reaction proceeded due to transported iron tannate or degradation products. As the citric acid was added, immediate clean-up of the high heat flux mild steel tubes ensued; however, the stainless steel and admiralty tubes continued to foul. The higher heat flux mild steel tubes failed to clean as well as the low heat flux tubes. Overall, the low velocity of the water was not as detrimental as expected. See FIG. 2.

PILOT COOLING TOWER RUN B

| | |
|---|---|
| Test and Tower No.: | 2, B (Shell Side Exchanger). |
| Purpose of Test: | Test is to be similar to Tower A test. However, the effects of Comp.P will be observed. A comparison of the tanninization effectiveness of wattle and chestnut tannin can be made. |

TABLE II-continued

| | |
|---|---|
| Water Type: | Three cycle Chicago tap; 0.1 ft/sec. |
| Tannin, Concentration, pH, Reaction Time: | Chestnut, 200 ppm; pH 6–7; 5–7 days. |
| Other Additives: | Comp.P, 170 ppm; 25 ppm Comp.B; 100 ppm Comp.I daily. |
| Specimens: | Seven tubes as in Tower A, same heat fluxes. |
| Transition Between Tannin and Deposit Removal Agent: | Stop tannin feed, slug in deposit removal agent and maintain dosage. |
| Removal Agent, Concentration, pH: | Citric acid, 2000 ppm, pH 3.6–3.9. |
| Other Additives: | Comp.P, 170 ppm; 25 ppm Comp.B; 100 ppm Comp.I daily. |
| Transition Between Deposit Removal Agent and Corrosion Inhibition Program: | Stop citric acid feed, high level with corrosion inhibitor. |
| Passivation Technique and Agents: | Comp.J, 200 ppm for 4 days, pH 7.6–8.0. |
| Transition Between Passivation and Maintenance Program. | Lower Comp.J dosage to 50 ppm. |

Summary of PCT Run: This run was considerably more successful than the wattle run. Some buildup of deposit on all tubes was noted as the tannin feed began. However, as the citric acid was added fouling decreased on all tubes, including the alloy tubes. In one day, the resistance of all tubes was below that of the corroded level. Minor fouling remained on the mild steel tubes. This test indicates that chestnut tannin is preferred to wattle. The dispersant may have aided in clean-up, but since the tannin was different in this tower, dispersant effectiveness cannot be estimated. No Comp.J data were collected. See FIG. 3.

PILOT COOLING TOWER RUN C

| | |
|---|---|
| Test and Tower No.: | 3, D (Tube Side Experiment) |
| Purpose of Test: | Test will compare effects of tube side water conditions as opposed to shell side conditions. Again, the effects of fouling of non-corroded surfaces will be studied. The effects of heat flux on fouling rate and degree will be examined. |
| Water Type: | Three cycle Chicago tap; 5 ft/sec. |
| Tannin, Concentration, pH | Chestnut, 200 ppm; pH 6–7; |
| Reaction time: | 5–7 days. |
| Other Additives: | 200 ppm Comp.P; 25 ppm Comp.B; 100 ppm Comp.I daily. |
| Specimens: | Mild steel tubes, 5000 and 15,000 BTU/ft$^2$/hr.; stainless steel tube 10,000 BTU/ft$^2$/hr.; admiralty tube, 5000 BTU/ft$^2$/hr. All pre-corroded in LOTS rig. |
| Transition Between Tannin and Deposit Removal Agent: | Same as Towers A and B. |
| Removal Agent, Concentration, pH: | Citric acid, 2000 ppm; adjusted to pH 3.4–3.8 with aqueous ammonia. |
| Other Additives: | Same as in tannin step. |
| Transition Between Deposit Removal Agent and Corrosion Inhibition Program: | Stop citric acid feed, then high level with corrosion inhibitor |
| Passivation Technique and Agents: | Comp.J, 150 ppm for 4 days, pH 7.6–8.0. |
| Transition Between Passivation and Maintenance Program: | Lower Comp.J level to 50 ppm |

Summary of PCT Run: This PCT run was quite similar to the Tower B run, except the flow velocity was 50 times greater and the total volume of the basin and hence the total amount of chemical fed was one-fourth that of Towers A and B. Build-up of deposit continued as the chestnut tannin was fed. Citric acid caused deposit removal within hours and left all tubes essentially clean. See FIG. 4.

TABLE II-continued

| PILOT COOLING TOWER RUN D | |
|---|---|
| Test and Tower No.: | 4, E (Tube Side Experiment) |
| Purpose of Test: | Similar to that of Tower D. To compare deposit transport by wattle tannin with that of chestnut tannin. To compare relative cleanliness of cleaned wattle specimens with those subjected to chestnut tannin. |
| Water Type: | Three cycle Chicago tap; 5 ft/sec. |
| Tannin, Concentration, pH, | Wattle, 200 ppm; pH 6–7; |
| Reaction Time: | 5–7 days. |
| Other Additives: | 25 ppm Comp.B; 100 ppm Comp.I daily. |
| Specimens: | Same as in Tower D. All pre-corroded in LOTS rig. |
| Transition Between Tannin and Deposit Removal Agent: | Stop tannin feed, slug in deposit removal agent, and maintain dosage. |
| Removal Agent, Concentration, pH: | Citric acid, 2000 ppm; pH adjusted to 3.4–3.8 with aqueous ammonia. |
| Other Additives: | Same as in tannin step. |
| Transition Between Deposit Removal Agent and Corrosion Inhibition Program: | Stop citric acid feed, then high level with corrosion inhibitor. |
| Passivation Technique and Agents: | Comp.D, 100 ppm, pH 6–7. |
| Transition Between Passivation and Maintenance Program: | Stop Comp.D feed and begin adding 130 ppm Comp.G gradually lowering dosage to 45 ppm after 4 days. |

Summary of PCT Run: This run parallels the test in Tower D. Tannation by the wattle was effective. Addition of citric acid cleaned the mild steel tubes, but the admiralty tubes did not unfoul significantly. These data confirm those obtained from Tower A. Transported deposits, therefore, are quite difficult to remove when wattle tannin is used. See FIG. 5.

| PILOT COOLING TOWER RUN E | |
|---|---|
| Test and Tower No.: | 5, E (Tube Side Experiment) |
| Purpose of Test: | To determine the effects of the cleaning procedure on mild steel tubes corroded for 3 months with 30 ppm chromate and 30 ppm Comp.H. To determine the effectiveness of air rumbling on tenacious deposits. |
| Water Type: | Three cycle Chicago tap; 2.5 ft/sec. |
| Tannin, Concentration, pH, | Chestnut, 200 ppm; pH 6–7; |
| Reaction Time: | 5 days. |
| Other Additives: | 170 ppm Comp.P; 100 ppm Comp.I daily. |
| Specimens: | Four extremely corroded M/S tubes, three of which had a heat flux of 10,000 BTU/ft$^2$/hr. and one unheated. |
| Transition Between Tannin and Deposit Removal Agent: | Stop tannin feed, slug in citric acid, maintain dosage. |
| Removal Agent, Concentration, pH: | Citric acid, 2000 ppm, uncontrolled pH (3.2–3.8). |
| Other Additives: | Same as in tannin step. |
| Transition Between Deposit Removal Agent and Corrosion Inhibition Program: | Stop citric acid feed, high level with corrosion inhibitor |
| Passivation Technique and Agents: | Comp.O, 200 ppm, pH 6–7. |
| Transition Between Passivation and Maintenance Program: | Lower Comp.O dosage to 65 ppm. |

Summary of PCT Run: Tannation appeared to proceed normally in this test, but because of the extremely thick deposit on all tubes it was difficult to determine when tannation had gone to near completion. Citric acid feed was started, but flaking of significant deposit was not evident. After 4 days of citric acid feed with uncontrolled pH, one mild steel tube developed a leak. The test was discontinued. This run points out the difficulties that TABLE II-continued might be encountered when treating any seriously corroded system.

| PILOT COOLING TOWER RUN F | |
|---|---|
| Test and Tower No.: | 6, F (Tube Side Experiment) |
| Purpose of Test: | To determine the detrimental effects of silt and process oils on the clean-up program. To compare Comp.M surfactant with high foamers. To examine the use of additional tannin as a passivating agent after deposit removal. |
| Water Type: | Three cycle Chicago tap; 2.5 ft/sec. |
| Tannin, Concentration, pH, | Wattle, 200 ppm; pH 6–7; |
| Reaction Time: | 3 days. |
| Other Additives: | 60 ppm Comp.H; 10 ppm Comp.M; 200 ppm process oil; 500 ppm Comp.L; 100 ppm Comp.I daily. |
| Specimens: | Three M/S tubes with 10,000 BTU/ft$^2$/hr. heat flux. Pre-corroded in the LOTS rig. |
| Transition Between Tannin and Deposit Removal Agent: | Stop tannin feed, slug in citrate, maintain dosage. |
| Removal Agent, Concentration, pH: | Citric acid, 3000 ppm, pH adjusted to 3.2–3.4 with aqueous ammonia. |
| Other Additives: | Same as above except no oil or silt. |
| Transition Between Deposit Removal Agent and Corrosion Inhibition Program: | Slowly blowdown citric acid when cleaning complete, add 200 ppm wattle tannin while increasing pH to 5.5. |
| Passivation Technique and Agents: | Wattle tannin at pH 5.5. |
| Transition Between Passivation and Maintenance Program: | None |

Summary of PCT Run: The presence of limited oil and Comp.L did not deter the process. The wattle tannin reacted with the corrosion product at the same rate as did the chestnut tannin in other tests. Introduction of citric acid flaked most of the modified deposit leaving a clean surface. The Comp. M appeared to work as well as the Comp.N with significantly less foaming. Use of additional tannin after the deposit removal and citric acid blowdown temporarily prevented re-corrosion, but a pH of 7.5–8.5 is necessary to make its inhibition effective for longer periods.

| PILOT COOLING TOWER RUN G | |
|---|---|
| Test and Tower No.: | 7, I (Tube Side Experiment) |
| Purpose of Test: | To compare results with those of Tower F since all conditions are the same except the tannin and surfactant used. Examine the use of a chromate/zinc program for passivation. |
| Water Type: | Three cycle Chicago tap; 2.5 ft/sec. |
| Tannin, Concentration, pH, | Chestnut, 200 ppm; pH 6–7; |
| Reaction Time: | 3 days. |
| Other Additives: | 60 ppm Comp.H; 10 ppm Comp.N; 200 ppm process oil; 500 ppm Comp.L; 100 ppm Comp.I daily. |
| Specimens: | Same as in Tower F. |
| Transition Between Tannin and Deposit Removal Agent: | Stop tannin feed, slug in citriate, maintain dosage. |
| Removal Agent, Concentration, pH: | Citric acid 3000 ppm, pH adjusted to 4.0 with aqueous ammonia. If removal at this pH is not good, lower pH. |
| Other Additives: | Same as above except no oil or silt. |
| Transition Between Deposit Removal Agent and Corrosion Inhibition Program: | Blowdown citrates for one day and slug in high level chromate/zinc program. |
| Passivation Technique and Agents: | Comp.G, 130 ppm, pH 6.5 |

TABLE II-continued

| | |
|---|---|
| Transition Between Passivation and Maintenance Program: | After 4 days at 130 ppm, lower Comp.G dosage to 45 ppm. |

Summary of PCT Run: The results of this test were similar in some ways to those from Tower F. Again, the oil and silt did not slow the cleaning process. Tannation with chestnut tannin proceeded well; however, use of 3000 ppm citrate at a pH of 4.0 did a poor job of spalling the tannated deposit. Only after the pH was lowered to 3.5 did most of the deposit fall off. The use of Comp. N produced much more foam than did the Comp.M surfactant. High leveling with Comp.G provided poor proection to the mild steel. It will be advantageous when using citrates to proceed immediately to the lower pH values (3.2–3.4) to accomplish deposit removal.

PILOT COOLING TOWER RUN H

| | |
|---|---|
| Test and Tower No.: | 8, J (Tube Side Experiment). |
| Purpose of Test: | To determine if higher dosages of tannin will improve the removal of corrosion product. To find the best conditions for using citric acid to remove tannated corrosion products. |
| Water Type: | Three cycle Chicago tap; 2.5 ft/sec. |
| Tannin, Concentration, pH, | Chestnut, 540 ppm; pH 5.0–7.3; |
| Reaction Time: | 5–7 days. |
| Other Additives: | 170 ppm Comp.P; 100 ppm Comp.I daily. |
| Specimens: | Four M/S tubes pre-corroded in LOTS rig for 11 days in Chicago tap water. |
| Tranisition Between Tannin and Deposit Removal Agent: | Stop tannin feed, slug in citrate, and maintain dosage. |
| Removal Agent, Concentration, pH: | Citric acid, adjust pH and dosage to obtain maximum deposit flaking. |
| Other Additives: | Same as in tannin step. |
| Transition Between Deposit Removal Agent and Corrosion Inhibition Program: | Blowdown citrates and introduce Comp.J program. |
| Passivation Technique and Agents: | Use Comp.J at 210 ppm and pH 7.6–8.1. |
| Transition Between Passivation and Maintenance Program: | None |

Summary of PCT Run: Higher concentrations of tannin and even longer tannation times did not prove advantageous over lower concentrations. Citric acid at 2000 ppm and pH 4.5 caused little or no deposit removal. The increased time used for this experiment (13 days) caused more transported deposit and implies that too much tannin is detrimental. Flushing of all used citric acid and residual tannin made possible complete cleaning at 2000–4000 ppm citric acid at pH 2.6. Prior attempts at 4000 ppm citric acid at pH 3.2–3.7 were not effective, probably due to high soluble Fe in the system. The Comp.J program failed due to poor pH control and microbiological build-up after Comp.I was discontinued. High heat flux can cause increased citric acid clean-up, but also produces a residual brown film.

PILOT COOLING TOWER RUN I

| | |
|---|---|
| Test and Tower No.: | 9, K (Tube Side Experiment) |
| Purpose of Test: | To determine the relationship between citrate concentration and pH for optimum deposit removal. To passivate cleaned systems with a chromate/zinc program. |
| Water Type: | Three cycle Chicago tap; 2.5 ft/sec. |
| Tannin, Concentration, pH, | Chestnut, 170 ppm; pH 5.6–6.0; |
| Reaction Time: | 3 days. |
| Other Additives: | 170 ppm Comp.P; 100 ppm Comp.I daily. |
| Specimens: | Three M/S tubes pre-corroded in LOTS rig for 4 days and an admiralty tube. |
| Transition Between Tannin and Deposit Removal Agent: | Stop tannin feed, slug in citrates, maintain dosage levels. |
| Removal Agent, Concentration, pH: | Citric acid; as in Tower J, determine optimum dosage and pH. |

TABLE II-continued

| | |
|---|---|
| Other Additives: | Same as in tannin step. |
| Transition Between Deposit Removal Agent and Corrosion Inhibition Program: | Bleed out citrates and slug in high level corrosion inhibition program. |
| Passivation Technique and Agents: | Comp.G, 130 ppm; pH 6.4–6.8. Maintain for several days. |
| Transition Between Passivation and Maintenance Program: | Lower Comp.G to 48 ppm. |

Summary of PCT Run: This run was similar to Tower J, except the chestnut tannin dosage was much lower for a shorter time. When 1900 ppm citric acid at pH 4.5 was used for deposit removal, flaking was minimal. However, at 2700 ppm and pH 4.5 with rapid blowdown to decrease dissolved Fe and residual tannin clean-up of scale was nearly complete. Final scale removal was acccomplished by increasing the citric acid level to 4000 ppm at pH 3.4. Passivation with Comp.G looked good, but a heavy light-colored scale eventually formed on the M/S tubes in spite of good pH and microbiological control.

PILOT COOLING TOWER RUN J

| | |
|---|---|
| Test and Tower No.: | 10, P (Tube Side Experiment) |
| Purpose of Test: | To determine ability of chestnut tannin to penetrate and modify very old deposits. To study the effects of citric acid on removing transported tannin complexes from admiralty tubes. To see if removal of large deposit chunks causes removal problems. |
| Water Type: | Three cycle Chicago tap; 2.5 ft/sec. |
| Tannin, Concentration, pH, | Chestnut, 185 ppm; pH 6.2–6.3; |
| Reaction Time: | 5 days. |
| Other Additives: | 30 ppm Comp.B; 215 ppm Comp.H; 100 ppm Comp. I daily. |
| Specimens: | Two extremely corroded M/S tubes (105 days in 30 ppm chromate) and 1 admiralty tube. |
| Transition Between Tannin and Deposit Removal Agent: | Stop tannin feed, slug in citrates and maintain feed. |
| Removal Agent, Concentration, pH: | Citric acid, 2000 ppm: pH 4.5 |
| Other Additives: | Same as in tannin step. |
| Transition Between Deposit Removal Agent and Corrosion Inhibition Program: | Blowdown cleaning solution and slug in program. |
| Passivation Technique and Agents: | Add 200 ppm Comp.O at pH 7.6–7.9. |
| Transition Between Passivation and Maintenance Program: | None |

Summary of PCT Run: This study was similar to Tower 5,E. Again, the extreme amount of corrosion product hampered complete tannation and deposit removal. No new information was obtained.

PILOT COOLING TOWER RUN K

| | |
|---|---|
| Test and Tower No.: | 11, Q |
| Purpose of Test: | To determine long term effects of tannin at low dosage levels on iron deposits. To attempt deposit removal by shocking deposits repeatedly with citrates. To attempt a Nalprep treatment of a cleaned system. |
| Water Type: | Three cycle Chicago tap; 2.5 ft/sec. |
| Tannin, Concentration, pH, | Wattle, 50 ppm; pH 5.3–6.0; |
| Reaction Time: | 13–15 days. |
| Other Additives: | 120 ppm Comp.H; 25 ppm Comp.B; 100 ppm Comp. I daily. |
| Specimens: | Two pre-corroded M/S tubes and 1 admiralty tube. |
| Transition Between Tannin | Stop tannin feed, slug in citric acid, |

TABLE II-continued

| | |
|---|---|
| and Deposit Removal Agent: | blowdown quickly and repeat. |
| Removal Agent, Concentration, pH: | Citric acid, 4000 ppm; pH 2.7–3.5. |
| Other Additives: | Same as in tannin step. |
| Transition Between Deposit Removal Agent and Corrosion Inhibition Program: | Blowdown heavily and quickly add Comp.F. |
| Passivation Technique and Agents: | Comp.F, 1.25% overnight; pH 6.0. |
| Transition Between Passivation and Maintenance Program: | Blowdown heavily and add 215 ppm Comp.J, pH 7.6. |

Summary of PCT Run: Tannation at a 50 ppm level produces essentially the same effect as that found at higher dosages for shorter times. Slugging the tannated deposit with citric acid at 4000 ppm at pH 2.5 for 4 times with complete draining and flushing between treatments was quite successful in removing the deposits. High heat flux aids, but was not essential for scale removal. A Comp.F passivation treatment was successful. Following passivation, a good start-up of the system with Comp.J was successful.

I claim:

1. A method for removing iron oxide deposits from heat transfer surfaces which comprises the sequential stepsl (a) contacting such surfaces with an aqueous solution which contains at least 25 parts per million of a hydrolyzable tanning extract and has a pH of not more than 8.5 for a period of time sufficient to complex with a substantial portion of the iron oxide deposits; and then (b) removing the complexed deposits formed in step (a) with an aqueous solution having a pH not greater than 4 which contains at least 1000 parts per million of citric acid.

2. The method of claim 1 where the hydrolyzable tanning extract is chestnut tannin.

3. The method of claim 1 where the tanning extract is gallotannic acid.

4. The method of claim 2 where the chestnut tannin is applied at a dosage rate of between 50–100 parts per million for 2–3 days at a pH of 3–7.

5. The method of claim 1 where the hydrolyzable tanning extract is used in conjunction with a few parts per million of a water-dispersible surfactant present in the solution containing the extract.

6. The method of claim 5 where the water-dispersible surfactant is a nonionic surfactant.

* * * * *